US010668597B2

(12) United States Patent
Poluha et al.

(10) Patent No.: US 10,668,597 B2
(45) Date of Patent: Jun. 2, 2020

(54) NONWOVEN ABRASIVE WHEEL WITH MOISTURE BARRIER LAYER

(71) Applicant: 3M INNOVATIVE PROPERTIES COMPANY, St. Paul, MN (US)

(72) Inventors: Laurie L. Poluha, Woodbury, MN (US); Jacob S. Beveridge, Lake Elmo, MN (US); Dean S. Holmes, Ellsworth, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 68 days.

(21) Appl. No.: 15/528,814

(22) PCT Filed: Nov. 24, 2015

(86) PCT No.: PCT/US2015/062394

§ 371 (c)(1),
(2) Date: May 23, 2017

(87) PCT Pub. No.: WO2016/089672

PCT Pub. Date: Jun. 9, 2016

(65) Prior Publication Data

US 2017/0334038 A1 Nov. 23, 2017

Related U.S. Application Data

(60) Provisional application No. 62/085,867, filed on Dec. 1, 2014.

(51) Int. Cl.

| | |
|---|---|
| ***B24D 3/02*** | (2006.01) |
| ***B24D 5/04*** | (2006.01) |
| ***B24D 3/28*** | (2006.01) |
| ***B24D 18/00*** | (2006.01) |

(52) U.S. Cl.
CPC ..... *B24D 3/02* (2013.01); *B24D 3/28* (2013.01); *B24D 5/04* (2013.01); *B24D 18/0045* (2013.01)

(58) Field of Classification Search
CPC ... B24D 3/02; B24D 3/28; B24D 5/04; B24D 18/45; B24D 18/0045
USPC ..... 451/544
See application file for complete search history.

(56) References Cited

U.S. PATENT DOCUMENTS 2,431,258 A * 11/1947 Kirchner ..... B24D 13/14 156/214
2,526,928 A * 10/1950 Borgerson ..... B24D 9/08 451/511
2,958,593 A * 11/1960 Hoover ..... A47L 13/04 451/532
3,016,294 A * 1/1962 Haywood ..... B24D 11/005 51/297

(Continued)

FOREIGN PATENT DOCUMENTS

CN 201346747 Y 11/2009
CN 201685187 12/2010

(Continued)

*Primary Examiner* — Timothy V Eley
(74) *Attorney, Agent, or Firm* — Katherine M. Scholz; Aleksander Medved; David B. Patchett

(57) ABSTRACT

A nonwoven abrasive wheel includes a nonwoven abrasive body having opposed first and second major surfaces and a moisture barrier layer arranged on at least one of the first and second major surfaces. Methods of making are also described.

20 Claims, 3 Drawing Sheets

(56) References Cited

U.S. PATENT DOCUMENTS 4,331,453 A * 5/1982 Dau ..... B24D 3/002 442/281
4,652,274 A 3/1987 Boettcher
4,903,440 A 2/1990 Larson
5,236,472 A 8/1993 Kirk
5,355,636 A * 10/1994 Harmon ..... B24D 11/02 428/480
5,378,252 A 6/1995 Follensbee
5,429,545 A * 7/1995 Meyer ..... A47L 13/17 451/523
5,487,940 A * 1/1996 Bianchini ..... C08J 7/04 206/524.6
5,549,719 A * 8/1996 Lee ..... B24D 3/28 51/295
5,591,239 A 1/1997 Larson
5,604,042 A * 2/1997 Bianchini ..... B32B 27/06 428/34.3
5,620,545 A * 4/1997 Braun ..... A62B 23/02 156/205
5,631,066 A * 5/1997 O'Brien ..... B32B 27/06 283/56
5,667,842 A 9/1997 Larson
5,712,210 A * 1/1998 Windisch ..... A47L 13/07 428/325
5,775,984 A * 7/1998 Olson ..... B24D 9/085 451/532
5,851,142 A * 12/1998 Bullock ..... B24B 29/02 451/508
5,858,140 A * 1/1999 Berger ..... B24D 3/28 156/62.2
5,919,549 A * 7/1999 Van ..... B24D 3/004 428/141
5,928,760 A * 7/1999 Usui ..... B24D 3/28 428/143
6,017,351 A * 1/2000 Street ..... A61B 17/54 606/131
6,017,831 A 1/2000 Beardsley
6,145,149 A * 11/2000 Azumi ..... A47L 11/164 15/230
6,352,567 B1 * 3/2002 Windisch ..... B24D 3/004 51/294
6,630,414 B1 * 10/2003 Matsumoto ..... A47C 31/006 428/114
6,780,096 B1 * 8/2004 Brown ..... B24D 9/006 156/189
6,805,722 B2 * 10/2004 Hunt ..... B24D 9/006 51/293
7,189,784 B2 3/2007 Barber, Jr.
7,393,371 B2 7/2008 O'Gary et al.
7,811,342 B1 * 10/2010 Hsu ..... B24D 11/001 51/298
7,985,269 B2 * 7/2011 Ludwig ..... B24D 3/28 51/293
8,715,381 B2 5/2014 Ramanath et al.
9,314,903 B2 * 4/2016 Woo ..... B24D 3/28
2002/0099347 A1 * 7/2002 Chen ..... A61F 13/512 604/369
2004/0082290 A1 * 4/2004 Yoshida ..... B24D 5/04 451/546
2004/0261208 A1 * 12/2004 McKay ..... A47L 23/266 15/215
2006/0000731 A1 * 1/2006 Hayne ..... B65D 75/002 206/372
2006/0003121 A1 * 1/2006 Scheller ..... B65D 33/2591 428/35.7
2006/0222796 A1 * 10/2006 Morris ..... B32B 27/08 428/35.7
2006/0265966 A1 * 11/2006 Rostal ..... B24D 3/004 51/295
2008/0233850 A1 9/2008 Woo et al.
2008/0311349 A1 * 12/2008 Johnson ..... C23C 14/024 428/172
2011/0155593 A1 * 6/2011 Zhang ..... B24D 3/346 206/223
2011/0183583 A1 * 7/2011 Joseph ..... B24B 37/22 451/41
2012/0107567 A1 * 5/2012 Terada ..... A61F 13/51104 428/156
2013/0037481 A1 * 2/2013 Lalouch ..... C02F 1/001 210/435
2013/0157544 A1 * 6/2013 McArdle ..... B24B 29/02 451/59
2013/0225054 A1 * 8/2013 Holmes ..... B24D 3/02 451/544
2014/0004316 A1 1/2014 Zhang
2016/0000291 A1 * 1/2016 Calderas ..... C11D 3/14 15/229.12

FOREIGN PATENT DOCUMENTS

WO WO 2007-005628 1/2007
WO WO 2012-106173 8/2012

* cited by examiner

NONWOVEN ABRASIVE WHEEL WITH MOISTURE BARRIER LAYER

CROSS REFERENCE TO RELATED APPLICATIONS

This application is a national stage filing under 35 U.S.C. 371 of PCT/US2015/062394, filed Nov. 24, 2015, which claims the benefit of U.S. Provisional Patent Application No. 62/085,867, filed Dec. 1, 2014, the disclosures of which are incorporated by reference in their entirety herein.

BACKGROUND

The present disclosure relates to nonwoven abrasive articles, such as unitized abrasive wheels and convolute abrasive wheels. More particularly, it relates to nonwoven abrasive articles having a moisture barrier layer, and methods of making nonwoven abrasive articles having a moisture barrier layer.

Nonwoven abrasive articles useful for abrading operations generally have a nonwoven fiber web (e.g., a lofty open fiber web), abrasive particles, and a binder material (commonly termed a "binder") that bonds the fibers to each other and secures the abrasive particles to the fiber web. Examples of nonwoven abrasive articles include nonwoven abrasive hand pads such as those marketed by 3M Company of Saint Paul, Minn. under the trade designation "SCOTCH-BRITE". Other examples of abrasive articles include convolute abrasive wheels and unitized abrasive wheels. Nonwoven abrasive wheels typically have abrasive particles distributed throughout layers of nonwoven fiber web bonded together with a binder material that bonds layers of nonwoven fiber web together, and likewise bonds the abrasive particles to the nonwoven fiber web. Unitized abrasive wheels have individual discs of nonwoven fiber web arranged in a parallel fashion to form a cylinder having a hollow axial core. Alternatively, convolute abrasive wheels have nonwoven fiber web spirally disposed and affixed to a core member.

Moisture in the form of, for example, humidity, can have a negative impact on the performance of on such nonwoven abrasive articles. More specifically, humidity can reduce the life and/or cut rate of nonwoven abrasive articles. To address this issue, nonwoven abrasive articles may be stored in a low humidity environment or placed in, for example, a desiccator.

SUMMARY

The need exists for a nonwoven abrasive article that overcomes the shortcomings noted above. That is, it would be desirable to provide a nonwoven abrasive article, such as a unitized wheel or a convolute wheel, that withstands the effects of humidity and moisture, thereby maintaining a long life and high level of abrading performance in high humidity environments, without the need for special handling and without storing the nonwoven abrasive article in low humidity conditions.

In one aspect, the present invention provides a nonwoven abrasive wheel comprising a nonwoven abrasive body having opposed first and second major surfaces, the nonwoven abrasive body comprising a nonwoven fiber web, abrasive particles, and binder material, and a moisture barrier layer arranged on at least one of the first and second major surfaces.

In another aspect, the present invention provides a method of making a nonwoven abrasive wheel, the method comprising providing a nonwoven abrasive wheel, providing a moisture barrier layer, and affixing the moisture barrier layer to at least one major surface of the nonwoven abrasive wheel. The moisture barrier layer may be affixed to the nonwoven abrasive wheel either during the forming of the abrasive wheel, or after the abrasive wheel has been formed.

In another aspect, the present invention provides a method of making a convolute abrasive wheel, the method comprising impregnating a fiber web with a curable binder composition, spirally winding the impregnated fiber web around a core member to form a curable perform, curing the curable preform to provide the convolute abrasive wheel, and affixing at least one layer of multilayer composite barrier to at least one major surface of the convolute abrasive wheel.

In another aspect, the present invention provides a unitized abrasive wheel comprising discs of nonwoven fiber web forming a cylinder having a hollow axial core, abrasive particles, and a binder binding the abrasive particles to the fibers of the layers of nonwoven fiber web and binding the layers of nonwoven fiber web to each other, and at least one layer of multilayer composite barrier affixed to at least one major surface of said unitized nonwoven abrasive wheel.

In another aspect, the present invention provides a method of making a unitized abrasive wheel having a hollow axial core, the method comprising providing layers of nonwoven fiber web impregnated with a curable binder composition; abrasive particles compressing the layers of nonwoven fiber web impregnated with the curable composition to provide a curable perform, curing the curable preform to provide a cured perform, forming the cured preform into the unitized abrasive wheel, and affixing at least one layer of multilayer composite barrier to at least one major surface of said unitized nonwoven abrasive wheel.

In the aforementioned abrasive articles, and methods for their making, the nonwoven fiber web may have a pre-bond resin thereon.

It is surprisingly found that nonwoven abrasive articles according to the present invention exhibit significant improvement in the cut performance, as evaluated according to the test methods presented herein, if compared to corresponding prior art nonwoven abrasive articles.

DETAILED DESCRIPTION

Figure 1A:
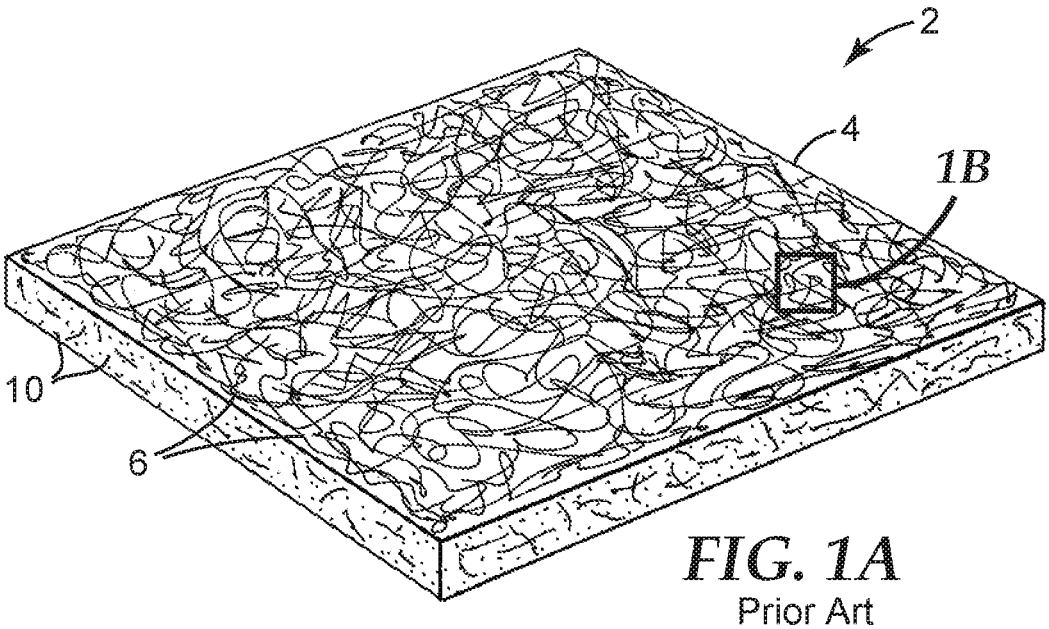
FIG. 1A Prior Art
FIG. 1A is a perspective view of an exemplary nonwoven abrasive article according to the prior art.
Figure 1B:
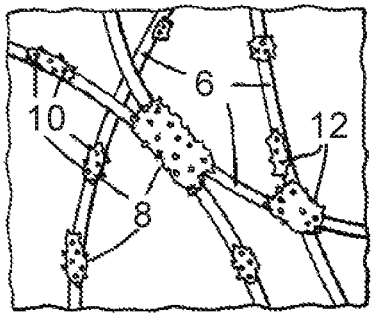
FIG. 1B Prior Art
FIG. 1B is an enlarged view of a region of the nonwoven abrasive article of FIG. 1A.

Referring now to the drawings, wherein like reference numerals refer to like or corresponding features throughout the several views, FIGS. 1A and 1B show a lofty nonwoven abrasive article 2 comprising an open low-density fibrous web 4 formed of entangled filaments or fibers 6 held together by a binder material 8. Abrasive particles 10 are dispersed throughout the fibrous web 4 and secured to the fibrous web 4 by the binder material 8. The binder material 8 coats portions of the filaments 6 and forms globules 12 that adhere to the surface of the filament 6 and/or collect at the intersection of contacting filaments 6, thereby providing abrasive sites throughout the nonwoven abrasive article 2.

Figure 2:
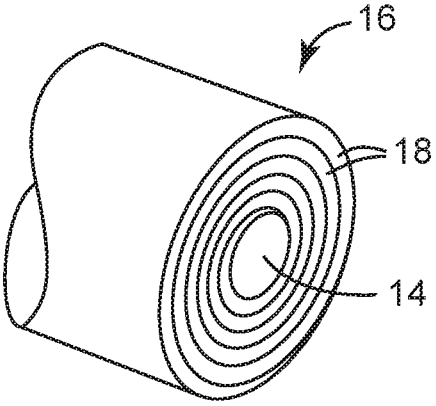
FIG. 2 Prior Art
FIG. 2 is a perspective view of an exemplary convolute abrasive wheel according to the prior art.
Figure 3:
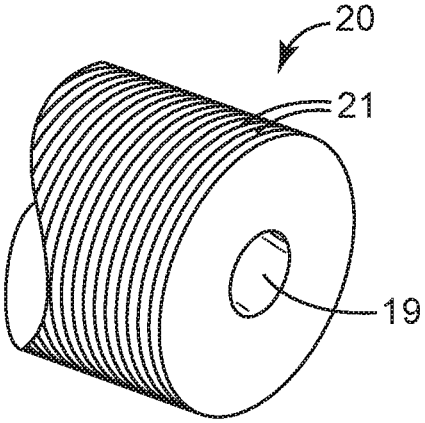
FIG. 3 Prior Art
FIG. 3 is a perspective schematic view of an exemplary unitized abrasive wheel according to one the prior art.

Various exemplary nonwoven abrasive articles according to the present invention, including convolute abrasive wheels, shown in FIG. 2, and unitized abrasive wheels, shown in FIG. 3, may be produced using the lofty nonwoven abrasive article 2 described in FIGS. 1A and 1B. As described more fully below, in the formation of convolute or unitized abrasive wheels, the lofty nonwoven abrasive article 2 is arranged in either a spiral or stacked arrangement, respectively, and then compressed (i.e., densified).

Convolute and unitized abrasive wheels may be manufactured using known techniques that generally include the steps of coating the nonwoven fiber web 4 with a binder precursor and abrasive particles, wrapping the coated nonwoven fiber web 4 in a spiral configuration (for a convolute wheel) or arranging plurality of discs in a stacked configuration (for a unitized wheel), compressing the web 4, and curing the binder precursor to provide the cured binder 8 that serves to bind the abrasive particles 10 to the layered nonwoven abrasive. The nonwoven fiber web 4 may be coated using known coating techniques including drop coating, in which the binder precursor is first applied to the fiber web 4 and then abrasive particles 10 are applied onto the precursor, or slurry coated, in which abrasive particles 10 are first mixed with the binder precursor and the slurry mixture is then applied to the fiber web 4.

An exemplary convolute abrasive wheel 16 is shown in FIG. 2. Convolute abrasive wheels may be produced by winding the nonwoven abrasive web 4 under tension around a core member 14 (e.g., a tubular or rod-shaped core member formed of, for example, paper, phenolic or synthetic plastic material), such that the layers of the nonwoven abrasive web 4 become compressed, and then curing the binder precursor (e.g. using heat) to provide a cured binder that serves to bind the abrasive particles 10 to the layered nonwoven abrasive. In this manner, the layered nonwoven fiber web 18, coated with binder material 8 binding the abrasive particles 10 to the layered nonwoven fiber web and binding layers of the layered nonwoven fiber web to each other, is spirally disposed around and affixed to core member 14. Abrasive wheels are then cut to the desired thickness. If desired, convolute abrasive wheels may be dressed prior to use to remove surface irregularities, for example, using methods known in the abrasive arts.

An exemplary unitized abrasive wheel 20 is shown in FIG. 3. Unitized abrasive wheels can be provided, for example, by layering the uncured impregnated nonwoven fiber web 4 described above as, for example, a continuous web or as a stack of sheets or discs 21, compressing the nonwoven fiber layers, curing the binder precursor (e.g., using heat), and die cutting the resultant abrasive article to provide a unitized abrasive wheel having a hollow axial through bore or opening. Formed in this manner, the unitized abrasive wheel 20 does not require a separate core member.

In compressing the layers of impregnated nonwoven fiber web, the layers (i.e. the layers 18 formed by the spiral wrap or the layers 21 formed by the discs) are typically compressed to form a slab having a density that is from 1 to 20 times that of the density of the layers in their non-compressed state. The slab is then typically subjected to heat molding (e.g., for from 2 to 20 hours) at elevated temperature (e.g., at 135° C.), typically depending on the binder precursor and slab size.

Figure 4A:
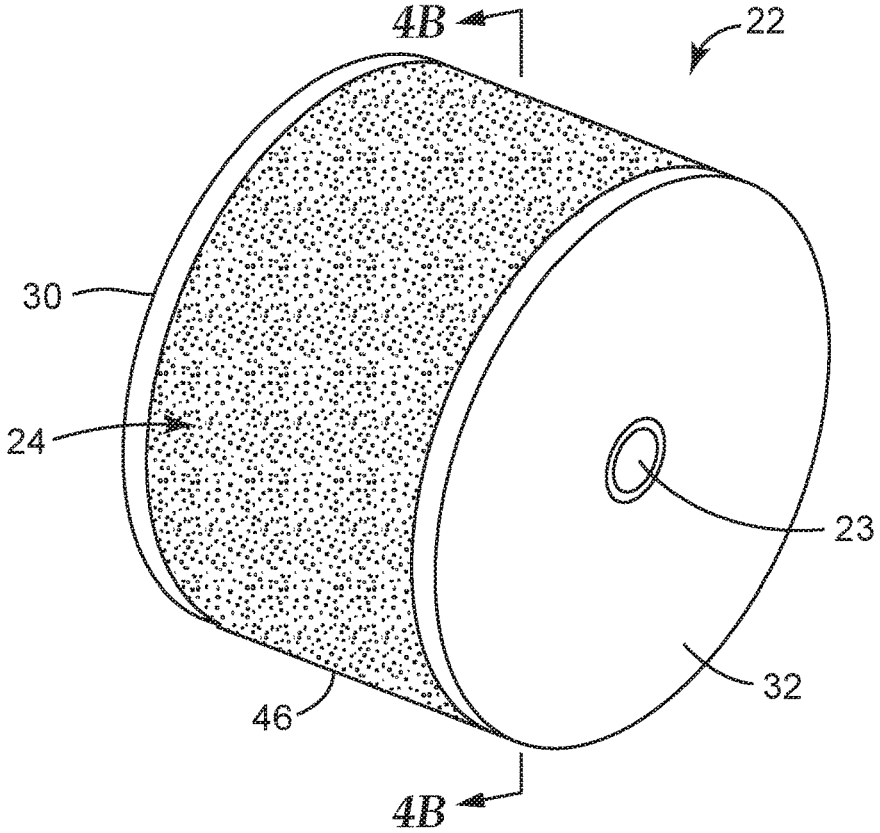
FIG. 4A is a perspective view of a convolute abrasive wheel according to one embodiment of the invention.
Figure 4B:
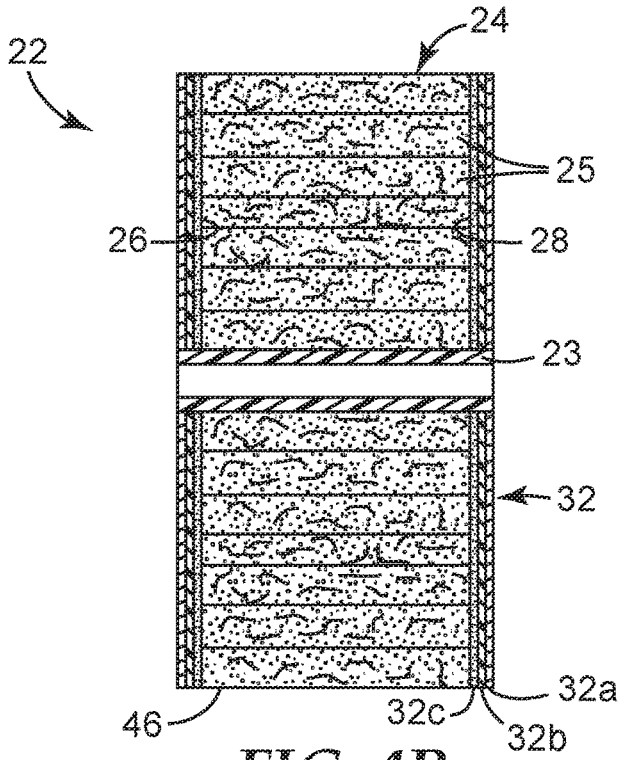
FIG. 4B is a cross-sectional view taken along line 4B-4B of FIG. 4A.

Referring now to FIGS. 4A and 4B, there is shown a convolute wheel 22 according to one embodiment of the invention. The convolute wheel 22 comprises a core 23, and a nonwoven abrasive body 24 in the form of a spirally wound abrasive nonwoven web wrapped around the core 23, thereby forming a plurality of radially arranged abrasive layers 25. The abrasive body 24 has opposed first and second major surfaces 26, 28, and a pair of moisture barrier layers 30, 32 arranged on the first and second major surfaces 26, 28 respectively. In the illustrated embodiment, the convolute wheel 22 includes an outer circumferential edge 46 that may be left exposed to ambient conditions. The nonwoven abrasive body 24 generally comprises a nonwoven fiber web having abrasive particles and binder material as described above in reference to FIGS. 1A and 1B.

Figure 5A:
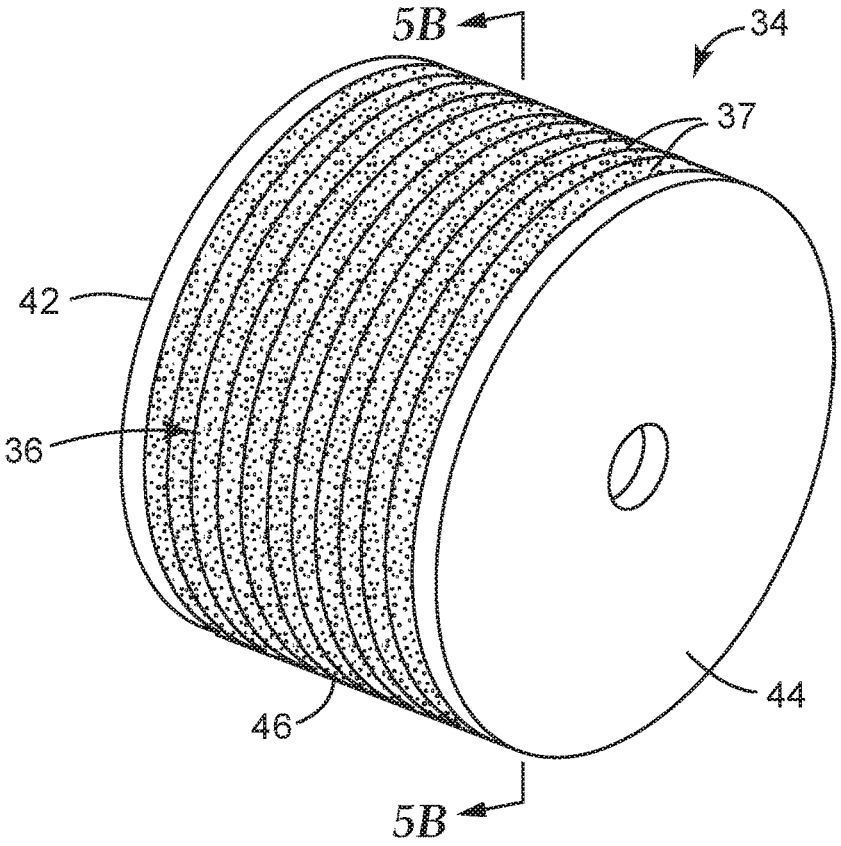
FIG. 5A is a perspective view of a unitized abrasive wheel according to one embodiment of the invention.
Figure 5B:
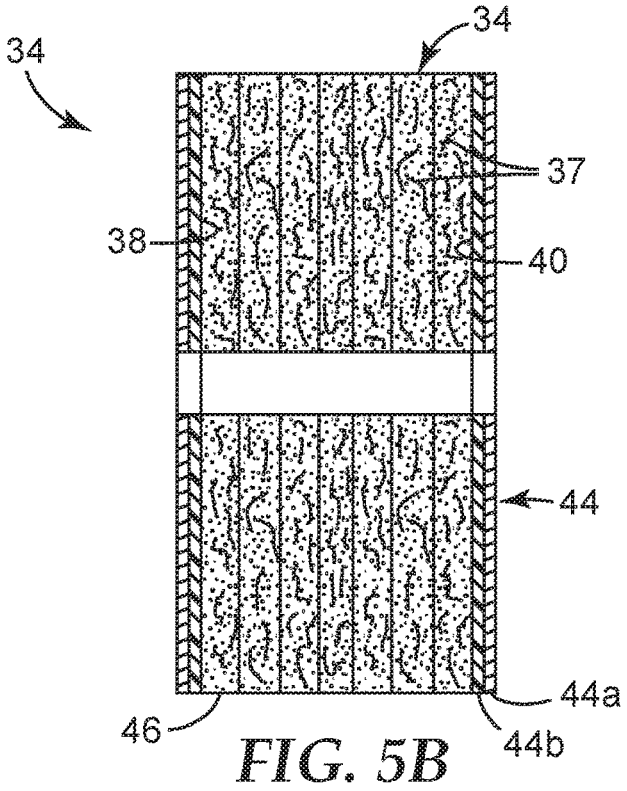
FIG. 5B is a cross-sectional view taken along line 5B-5B of FIG. 5A.

Referring now to FIGS. 5A and 5B, there is shown a unitized wheel 34 according to another embodiment of the invention. The unitized wheel 34 comprises a nonwoven abrasive body 36 formed of a plurality of axially arranged nonwoven discs 37. The abrasive body 36 has opposed first and second major surfaces 38, 40, and a pair of moisture barrier layers 42, 44 arranged on the first and second major surfaces 38, 40 respectively. As was the case with the convolute wheel 22 described in reference to FIGS. 4A and 4B, unitized wheel 34 includes an outer circumferential edge 46 that may be left exposed to ambient conditions, and the nonwoven abrasive body 36 comprises a nonwoven fiber web having abrasive particles and binder material as described above in reference to FIGS. 1A and 1B.

Surprisingly, it has been found that by providing a moisture barrier layer on at least one of the first and second major surfaces of a nonwoven abrasive wheel, the deleterious effects of humidity and moisture on the performance of the abrasive wheel can be significantly reduced. Because the nonwoven abrasive wheels include a nonwoven abrasive body, humidity and moisture was expected to quickly penetrate the abrasive body and products results similar to those generated with an a nonwoven abrasive wheel having no moisture barrier. Thus, the improved performance was surprising and unexpected.

In a specific aspect of the invention, the nonwoven abrasive body 24 of the convolute wheel 22 and the nonwoven abrasive body 36 of the unitized wheel 34 may have a density of at least about 1 grams/in$^3$, at least about 2 grams/in$^3$, or at least about 4 grams/in$^3$, and a density of no greater than about 35 grams/in$^3$, no greater than about 50 grams/in$^3$, or no greater than about 75 grams/in$^3$.

In one embodiment, the moisture barrier layers 30, 32, 42, 44 may comprise a metalized film. The metalized film may be affixed directly to the abrasive body of the nonwoven abrasive wheel without adhesive by, for example, pressing the metalized film against the abrasive body 24, 36 when the abrasive wheel is produced. Alternatively, the metalized film may be adhesively bonded to the abrasive body 24, 36 after the abrasive body 24, 36 is produced.

In one embodiment, the metalized film may comprise a polymer layer and a metal layer. In the illustrated embodiment, the moisture barrier layers 30, 32, 42, 44 comprise a metal layer 32*a*, 44*a*, a polymer layer 32*b*, 44*b*, and an adhesive layer 32*c*. In this manner, the moisture barrier layers 20, 32, 42, 44 are provided in the form of metalized film tapes that can be adhesively bonded to the opposed major surfaces 26, 28, 38, 40, respectively, of the convolute wheel 22 and the unitized wheel 34, respectively.

In a specific embodiment, the metal layer 32*a*, 44*a* may include, for example, aluminum, nickel, chromium, copper, gold, platinum, silver, and mixtures thereof, the polymer layer 32*b*, 44*b* may include a polyester film layer (i.e. polyethylene terephthalate), and the adhesive layer may include an acrylic adhesive.

In one aspect, the metalized film may have a thickness of at least about 0.5 mil, at least about 1.0 mil, or at least about 1.5 mil, and a thickness of no greater than about 6 mil, no greater than about 4 mil, no greater than about 3 mil.

In another aspect, the metalized film may have a water vapor transmission rate as measured according to ASTM F1249-01 (Standard Test Method for Water Vapor Transmission Rater Through Plastic Film and Sheeting Using a Modulated Infrared Sensor) of less than about 0.05 g/100 $in^2$/24 hour, less than about 0.04 g/100 $in^2$/24 hour, or less than about 0.03 g/100 $in^2$/24 hour.

In a specific aspect, the moisture barrier layers 30, 32, 42, 44 comprise a metalized polyester film tape adhesively bonded to the entirety of at least one of the first 26, 38 and second 28, 40 major surfaces. It will be recognized, however, that depending on the desired level of moisture protection, the moisture barrier layers 30, 32, 42, 44 may be provided on less than the entirety of the first 26, 38 and second 28, 40 major surfaces. In the illustrated embodiment, moisture barrier layers 30, 32, 42, 44 are provided on each of the first 26, 38 and second 42, 44 major surfaces. It will be recognized, however, that depending on the desired level of moisture protection, a moisture barrier layer may be provided on only one of the first 26, 38, 42, 44 and second major surfaces.

Suitable materials for the moisture barrier layers 30, 32, 42, 44 include metalized polyester film tapes available from Technical Tapes and Solutions, Nashville, Tenn., including MMYP-1, metalized polyester film available from Celplast Metallized Products Ltd, Toronto, Ontario, including 48 ga FOILMET PLUS POLYESTER metalized polyester film, and Value Brand metalized film tape available from Zoro, Buffalo Grove, Ill.

Useful binder precursors include, for example, polyurethane compositions comprising a curable polyurethane prepolymer, an effective amount of an amine curative, and phenolic resin. The binder precursor may further include optional additives.

Nonwoven fiber webs 4 suitable for use in the aforementioned abrasive articles are known in the abrasives art. Typically, the nonwoven fiber web 4 comprises an entangled web of filaments or fibers 6. The fibers 6 may comprise continuous fiber, staple fiber, or a combination thereof. For example, the fiber web 4 may comprise staple fibers having a length of at least about 20 millimeters (mm), at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter. The fiber web 4 may be made, for example, by conventional air laid, carded, stitch bonded, spun bonded, wet laid, and/or melt blown procedures. Air laid fiber webs may be prepared using equipment such as, for example, that available under the trade designation "RANDO WEBBER" commercially available from Rando Machine Company of Macedon, N.Y.

Nonwoven fiber webs are typically selected to be suitably compatible with adhering binders and abrasive particles while also being processable in combination with other components of the article, and typically can withstand processing conditions (e.g., temperatures) such as those employed during application and curing of the binder precursor. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include agave, cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped, but may also be continuous filaments such as those formed by an extrusion process. Combinations of fibers may also be used.

Prior to impregnation with the binder precursor, the nonwoven fiber web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the curable composition or optional pre-bond resin), although greater and lesser basis weights may also be used. In addition, prior to impregnation with the curable composition, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, abrasive wheels and methods for their manufacture may be found, for example, in U.S. Pat. No. 2,958,593 (Hoover et al.); U.S. Pat. No. 5,591,239 (Larson et al.); U.S. Pat. No. 6,017,831 (Beardsley et al.), and U.S. Pat. No. 7,189,784 (Barber, Jr.), the entire contents of which are hereby by reference.

Frequently, as known in the abrasive art, it is useful to apply a pre-bond resin to the nonwoven fiber web prior to coating with the binder precursor. The pre-bond resin serves, for example, to help maintain the nonwoven fiber web integrity during handling, and may also facilitate bonding of the binder precursor to the nonwoven fiber web. Examples of pre-bond resins include phenolic resins, urethane resins, hide glue, acrylic resins, urea-formaldehyde resins, melamine-formaldehyde resins, epoxy resins, and combinations thereof. The amount of pre-bond resin used in this manner is typically adjusted toward the minimum amount consistent with bonding the fibers together at their points of crossing contact. In those cases, wherein the nonwoven fiber web includes thermally bondable fibers, thermal bonding of the nonwoven fiber web may also be helpful to maintain web integrity during processing.

Examples of useful abrasive particles include any abrasive particles known in the abrasive art. Exemplary useful abrasive particles include fused aluminum oxide based materials such as aluminum oxide, ceramic aluminum oxide (which may include one or more metal oxide modifiers and/or seeding or nucleating agents), and heat-treated aluminum oxide, silicon carbide, co-fused alumina-zirconia, diamond, ceria, titanium diboride, cubic boron nitride, boron carbide, garnet, flint, emery, sol-gel derived abrasive particles, and mixtures thereof. The abrasive particles may be in the form of, for example, individual particles, agglomerates, composite particles, formed abrasive particles, and mixtures thereof.

The abrasive particles may, for example, have an average diameter of at least about 0.1 micrometer, at least about 1 micrometer, or at least about 10 micrometers, and less than about 2000, less than about 1300 micrometers, or less than about 1000 micrometers, although larger and smaller abrasive particles may also be used. For example, the abrasive particles may have an abrasives industry specified nominal grade. Such abrasives industry accepted grading standards include those known as the American National Standards Institute, Inc. (ANSI) standards, Federation of European Producers of Abrasive Products (FEPA) standards, and Japanese Industrial Standard (JIS) standards. Exemplary ANSI grade designations (i.e., specified nominal grades) include: ANSI 4, ANSI 6, ANSI 8, ANSI 16, ANSI 24, ANSI 36, ANSI 40, ANSI 50, ANSI 60, ANSI 80, ANSI 100, ANSI 120, ANSI 150, ANSI 180, ANSI 220, ANSI 240, ANSI 280, ANSI 320, ANSI 360, ANSI 400, and ANSI 600. Exemplary FEPA grade designations include P8, P12, P16, P24, P36, P40, P50, P60, P80, P100, P120, P150, P180, P220, P320, P400, P500, 600, P800, P1000, and P1200. Exemplary JIS grade designations include HS8, JIS12, JIS16, JIS24, JIS36, JIS46, JIS54, JIS60, JIS80, JIS100, JIS 150, JIS 180, JIS220, JIS 240, JIS280, JIS320, JIS360, JIS400, JIS400, JIS600, JIS800, JIS1000, JIS1500, JIS2500, JIS4000, JIS6000, JIS8000, and JIS10000.

Typically, the coating weight for the abrasive particles (independent of other ingredients in the binder precursor) may depend, for example, on the particular binder precursor used, the process for applying the abrasive particles, and the size of the abrasive particles. For example, the coating weight of the abrasive particles on the nonwoven fiber web (before any compression) may be at least 200 grams per square meter ($g/m^2$), at least 600 $g/m^2$, or at least 800 $g/m^2$; and/or less than 2000 $g/m^2$, less than about 1600 $g/m^2$, or less than about 1200 $g/m^2$, although greater or lesser coating weights may be also be used.

Suitable crosslinkable binder precursors can include either condensation curable materials or addition polymerizable materials. Addition polymerizable materials can be ethylenically unsaturated monomers and/or oligomers. Examples of crosslinkable materials include phenolic resins, bismaleimide binders, vinyl ethers, aminoplasts having pendant alpha, beta unsaturated carbonyl groups, urethanes, epoxies, acrylates, acrylated isocyanurates, urea-formaldehydes, isocyanurates, acrylated urethanes, acrylated epoxies, or mixtures of any of the foregoing.

Phenolic materials can be preferred binder precursors because of their thermal properties, availability, cost, and ease of handling. Resole phenolics have a molar ratio of formaldehyde to phenol of greater than or equal to one, typically between 1.5:1.0 to 3.0:1.0. Novolac phenolics have a molar ratio of formaldehyde to phenol of less than 1.0:1.0. Examples of commercially available phenolics include those known by the trade names DUREZ and VARCUM from Occidental Chemicals Corp.; RESINOX from Monsanto; AROFENE from Ashland Chemical Co. and AROTAP from Ashland Chemical Co.

Some binder precursors include a phenolic mixed with a latex. Examples of such latexes include materials containing acrylonitrile butadiene, acrylics, butadiene, butadiene-styrene, and combinations thereof. These latexes are commercially available from a variety of different sources and include those available under the trade designations RHOPLEX and ACRYLSOL commercially available from Rohm and Haas Company, FLEXCRYL and VALTAC commercially available from Air Products & Chemicals Inc., SYNTHEMUL, TYCRYL, and TYLAC commercially available from Reichold Chemical Co., HYCAR and GOODRITE commercially available from B. F. Goodrich, CHEMIGUM commercially available from Goodyear Tire and Rubber Co., NEOCRYL commercially available from ICI, BUTAFON commercially available from BASF, and RES commercially available from Union Carbide.

Epoxies, i.e., materials having an oxirane group which can be polymerized by ring opening, can be useful within a binder precursor either as a monomeric compound or as medium or high molecular weight dimers, trimers, oligomers, prepolymers, polymers, etc. Epoxy compounds can vary greatly in the nature of their backbones and substituent groups. For example, the backbone may be of any type normally associated with an epoxy-functional polymer, and substituent groups thereon can be any group free of an active hydrogen atom that is reactive with an oxirane group at room temperature. Representative examples of acceptable substituent groups include halogens, ester groups, ether groups, sulfonate groups, siloxane groups, nitro groups and phosphate groups. Examples of some preferred epoxy materials include compositions containing a diglycidyl ether of bisphenol A, as well as materials that are commercially available under the trade designations EPON 828, EPON 1004, and EPON 1001F, available from Shell Chemical Co., DER-331, DER-332, and DER-334, available from Dow Chemical Co. Other suitable epoxies include glycidyl ethers of phenol formaldehyde novolac (e.g., DEN-431 and DEN-428 available from Dow Chemical Co.).

Examples of ethylenically unsaturated binder precursors include aminoplast monomer or oligomer having pendant alpha, beta-unsaturated carbonyl groups, ethylenically unsaturated monomers or oligomers, acrylated isocyanurate monomers, acrylated urethane oligomers, acrylated epoxy monomers or oligomers, ethylenically unsaturated monomers or diluents, acrylate dispersions or mixtures thereof.

Aminoplast binder precursors have at least one pendant alpha, beta-unsaturated carbonyl group per molecule or oligomer. These materials are further described in U.S. Pat. Nos. 4,903,440 and 5,236,472, the entire contents of which are incorporated herein by reference.

Ethylenically unsaturated monomers or oligomers may be monofunctional, difunctional, trifunctional, or tetrafunctional or of even higher functionality. The term "acrylate" as used herein is intended to include both acrylates and methacrylates. Ethylenically unsaturated binder precursors include monomeric, oligomeric, and polymeric compounds that contain atoms of carbon, hydrogen, and oxygen, and optionally, nitrogen and the halogens. Oxygen or nitrogen atoms or both are generally present in ether, ester, urethane, amide, or urea groups. Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerthryitol triacrylate, pentaerythritol trimethacrylate, pentaerythritol tetraacrylate and pentaerythritol tetramethacrylate. Other ethylenically unsaturated resins include monoallyl, polyallyl, and polymethallyl esters and amides of carboxylic acids, such as diallyl phthalate, diallyl adipate, and N,N-diallyladipamide. Still others include nitrogen-containing compounds such as tris(2-acryl-oxyethyl)isocyanurate, 1,3,5-tri(2-methyacryloxyethyl)-s-triazine, acrylamide, methylacrylamide, N-methyl-acrylamide, N,N-dimethylacrylamide, N-vinyl-pyrrolidone, and N-vinyl-piperidone.

Isocyanurate derivatives having at least one pendant acrylate group and isocyanate derivatives having at least one pendant acrylate group are further described in U.S. Pat. No. 4,652,274, the entire contents of which are hereby incorporated by reference. A preferred isocyanurate material is a triacrylate of tris(hydroxy ethyl) isocyanurate.

Examples of acrylated urethanes include diacrylate esters of hydroxy terminated isocyanate extended polyesters or polyethers. Examples of commercially available acrylated urethanes include those available under the trade designations UVITHANE 782, available from Morton Chemical, and CMD 6600, CMD 8400, and CMD 8805, available from UCB Radcure Specialties. Examples of acrylated epoxies include diacrylate esters of epoxy resins, such as the diacrylate esters of bisphenol A epoxy resin. Examples of commercially available acrylated epoxies include those available under the trade designations CMD 3500, CMD 3600, and CMD 3700, available from UCB Radcure Specialties.

Examples of acrylated urethanes include diacrylate esters of hydroxy terminated NCO extended polyesters or polyethers. Examples of commercially available acrylated urethanes include UVITHANE 782, available from Morton Thiokol Chemical, and CMD 6600, CMD 8400, and CMD 8805, available from Radcure Specialties.

Examples of acrylated epoxies include diacrylate esters of epoxy resins such as the diacrylate esters of bisphenol A epoxy resin. Examples of commercially available acrylated epoxies include CMD 3500, CMD 3600, and CMD 3700, available from Radcure Specialties.

Examples of ethylenically unsaturated diluents or monomers can be found in U.S. Pat. No. 5,236,472 (Kirk et al.) and U.S. Pat. No. 5,667,842, the entire contents of which are hereby incorporated by reference. In some instances these ethylenically unsaturated diluents are useful because they tend to be compatible with water.

Additional details concerning acrylate dispersions can be found in U.S. Pat. No. 5,378,252 (Follensbee), the entire contents of which are hereby incorporated by reference.

Examples of useful urethane prepolymers include polyisocyanates and blocked versions thereof. Typically, blocked polyisocyanates are substantially unreactive to isocyanate reactive compounds (e.g., amines, alcohols, thiols, etc.) under ambient conditions (e.g., temperatures in a range of from about 20° C. to about 25° C.), but upon application of sufficient thermal energy the blocking agent is released, thereby generating isocyanate functionality that reacts with the amine curative to form a covalent bond.

Useful polyisocyanates include, for example, aliphatic polyisocyanates (e.g., hexamethylene diisocyanate or trimethylhexamethylene diisocyanate); alicyclic polyisocyanates (e.g., hydrogenated xylylene diisocyanate or isophorone diisocyanate); aromatic polyisocyanates (e.g., tolylene diisocyanate or 4,4'-diphenylmethane diisocyanate); adducts of any of the foregoing polyisocyanates with a polyhydric alcohol (e.g., a diol, low molecular weight hydroxyl group-containing polyester resin, water, etc.); adducts of the foregoing polyisocyanates (e.g., isocyanurates, biurets); and mixtures thereof.

Useful commercially available polyisocyanates include, for example, those available under the trade designation "ADIPRENE" from Chemtura Corporation, Middlebury, Conn. (e.g., "ADIPRENE L 0311", "ADIPRENE L 100", "ADIPRENE L 167", "ADIPRENE L 213", "ADIPRENE L 315", "ADIPRENE L 680", "ADIPRENE LF 1800A", "ADIPRENE LF 600D", "ADIPRENE LFP 1950A", "ADIPRENE LFP 2950A", "ADIPRENE LFP 590D", "ADIPRENE LW 520", and "ADIPRENE PP 1095"); polyisocyanates available under the trade designation "MONDUR" from Bayer Corporation, Pittsburgh, Pa. (e.g., "MONDUR 1437", "MONDUR MP-095", or "MONDUR 448"); and polyisocyanates available under the trade designations "AIRTHANE" and "VERSATHANE" from Air Products and Chemicals, Allentown, Pa. (e.g., "AIRTHANE APC-504", "AIRTHANE PST-95A", "AIRTHANE PST-85A", "AIRTHANE PET-91A", "AIRTHANE PET-75D", "VERSATHANE STE-95A", "VERSATHANE STE-P95", "VERSATHANE STS-55", "VERSATHANE SME-90A", and "VERSATHANE MS-90A").

To lengthen pot-life, polyisocyanates such as, for example, those mentioned above may be blocked with a blocking agent according to various techniques known in the art. Exemplary blocking agents include ketoximes (e.g., 2-butanone oxime); lactams (e.g., epsilon-caprolactam); malonic esters (e.g., dimethyl malonate and diethyl malonate); pyrazoles (e.g., 3,5-dimethylpyrazole); alcohols including tertiary alcohols (e.g., t-butanol or 2,2-dimethylpentanol), phenols (e.g., alkylated phenols), and mixtures of alcohols as described.

Exemplary useful commercially available blocked polyisocyanates include those marketed by Chemtura Corporation under the trade designations "ADIPRENE BL 11", "ADIPRENE BL 16", "ADIPRENE BL 31", and blocked polyisocyanates marketed by Baxenden Chemicals, Ltd., Accrington, England under the trade designation "TRIXENE" (e.g., "TRIXENE BL 7641", "TRIXENE BL 7642", "TRIXENE BL 7772", and "TRIXENE BL 7774").

Typically, the amount of urethane prepolymer present in the curable composition is in an amount of from 10 to 40 percent by weight, more typically in an amount of from 15 to 30 percent by weight, and even more typically in an amount of from 20 to 25 percent by weight based on the total weight of the curable composition, although amounts outside of these ranges may also be used.

Suitable amine curatives include aromatic, alkyl-aromatic, or alkyl polyfunctional amines, preferably primary amines. Examples of useful amine curatives include 4,4'-methylenedianiline; polymeric methylene dianilines having a functionality of 2.1 to 4.0 which include those known under the trade designations "CURITHANE 103", commercially available from the Dow Chemical Company, and "MDA-85" from Bayer Corporation, Pittsburgh, Pa.; 1,5-diamine-2-methylpentane; tris(2-aminoethyl) amine; 3-aminomethyl-3,5,5-trimethylcyclohexylamine (i.e., isophoronediamine), trimethylene glycol di-p-aminobenzoate, bis(o-aminophenylthio)ethane, 4,4'-methylenebis(dimethyl anthranilate), bis(4-amino-3-ethylphenyl)methane (e.g., as marketed under the trade designation "KAYAHARD AA" by Nippon Kayaku Company, Ltd., Tokyo, Japan), and bis(4-amino-3,5-diethylphenyl)methane (e.g., as marketed under the trade designation "LONZACURE M-DEA" by Lonza, Ltd., Basel, Switzerland), and mixtures thereof. If desired, polyol(s) may be added to the curable composition, for example, to modify (e.g., to retard) cure rates as required by the intended use.

The amine curative should be present in an amount effective to cure the blocked polyisocyanate to the degree required by the intended application; for example, the amine curative may be present in a stoichiometric ratio of curative to isocyanate (or blocked isocyanate) in a range of from 0.8 to 1.35; for example, in a range of from 0.85 to 1.20, or in a range of from 0.90 to 0.95, although stoichiometric ratios outside these ranges may also be used.

Typically, the curable composition will include at least one organic solvent (e.g., isopropyl alcohol or methyl ethyl ketone) to facilitate coating of the curable composition on the nonwoven fiber web, although this is not a requirement.

Optionally, the curable composition may be mixed with and/or include one or more additives. Exemplary additives include fillers, plasticizers, surfactants, lubricants, colorants (e.g., pigments), bactericides, fungicides, grinding aids, and antistatic agents.

In one exemplary method of making nonwoven abrasive articles according to the present invention there are the steps of, in this sequence, applying a prebond coating to the nonwoven fiber web (e.g., by roll-coating or spray coating), curing the prebond coating, impregnating the nonwoven fiber web with the binder precursor (e.g., by roll-coating or spray coating), and curing the curable composition.

Typically, the curable composition (including any solvent that may be present) is coated onto the nonwoven fiber web in an amount of from 1120 to 2080 gsm, more typically 1280-1920 gsm, and even more typically 1440-1760 gsm, although values outside these ranges may also be used.

What is claimed is:

1. A nonwoven abrasive wheel comprising:

a nonwoven abrasive body having opposed first and second major surfaces, the nonwoven abrasive body comprising a nonwoven fiber web, abrasive particles, and binder material; and a moisture barrier layer arranged on at least one of the first and second major surfaces.

2. A nonwoven abrasive wheel as defined in claim 1, wherein the nonwoven abrasive wheel is a unitized wheel.

3. A nonwoven abrasive wheel as defined in claim 1, wherein the nonwoven abrasive wheel is a convolute wheel.

4. A nonwoven abrasive wheel as defined in claim 1, wherein the nonwoven abrasive body has a density of at least 1 gram/in$^3$ and no greater than 75 grams/in$^3$.

5. A nonwoven abrasive wheel as defined in claim 1, wherein the moisture barrier layer comprises a metalized film.

6. A nonwoven abrasive wheel as defined in claim 5, wherein the metalized film comprises a polymer layer and a metal layer.

7. A nonwoven abrasive wheel as defined in claim 6, wherein the metalized film further comprises an adhesive layer.

8. A nonwoven abrasive wheel as defined in claim 6, wherein the polymer layer comprises polyester (polyethylene terephthalate).

9. A nonwoven abrasive wheel as defined in claim 7, wherein the adhesive layer comprises an acrylic adhesive.

10. A nonwoven abrasive wheel as defined in claim 5, wherein the metalized film includes a metal selected from the group consisting of aluminum, nickel, chromium, copper, gold, platinum, silver, and mixtures thereof.

11. A nonwoven abrasive wheel as defined in claim 5, wherein the metalized film has a thickness of at least 0.5 mil, and no greater than 6 mil.

12. A nonwoven abrasive wheel as defined in claim 5, wherein the metalized film has a water vapor transmission rate of less than 0.05 g/100 in$^2$/24 hour when measured according to ASTM F1249-01.

13. A nonwoven abrasive wheel as defined in claim 1, wherein the moisture barrier layer comprises a metalized polyester film tape adhesively bonded to the entire surface of at least one of the first and second major surfaces.

14. A nonwoven abrasive wheel as defined in claim 1, wherein moisture barrier layers are provided on each of the first and second major surfaces.

15. A nonwoven abrasive wheel as defined in claim 1, wherein the moisture barrier layer is adhesively bonded to the abrasive body.

16. A nonwoven abrasive wheel as defined in claim 1, wherein the moisture barrier layer is affixed to the abrasive body without the use of adhesive.

17. A method of making a nonwoven abrasive wheel, comprising the steps of:

providing a nonwoven abrasive body having opposed first and second major surfaces, wherein the nonwoven abrasive body comprises a nonwoven fiber web, abrasive particles, and binder material; and affixing a moisture barrier layer on at least one of the first and second major surfaces of the abrasive body.

18. A method of making a nonwoven abrasive wheel as defined in claim 17, wherein the nonwoven abrasive wheel is at least one of a convolute abrasive wheel and a unitized abrasive wheel, and further wherein the abrasive body has a density of at least 1 gram/in$^3$ and has a density less than 75 grams/in$^3$.

19. A method of making a nonwoven abrasive wheel as defined in claim 18, wherein the moisture barrier layer comprises a composition metalized film comprising a metal layer selected from the group consisting of aluminum, nickel, chromium, copper, gold, platinum, silver, and mixtures thereof, and a polyester layer.

20. A method of making a nonwoven abrasive wheel as defined in claim 19, wherein the moisture barrier film is affixed to the abrasive body by an adhesive.

* * * * *